US005431136A

United States Patent [19]

Kenmoku et al.

[11] Patent Number: 5,431,136

[45] Date of Patent: Jul. 11, 1995

[54] INTERNAL COMBUSTION VALVE HAVING AN IRON BASED HARD-FACING ALLOY CONTACT SURFACE

[75] Inventors: Takeji Kenmoku, Fujisawa; Akihiro Hamada, Machida, both of Japan

[73] Assignee: Fuji Oozx Inc., Japan

[21] Appl. No.: 358,877

[22] Filed: Dec. 19, 1994

[30] Foreign Application Priority Data

Dec. 22, 1993 [JP] Japan ..... 5-324249

[51] Int. Cl.[6] ..... F01L 3/02

[52] U.S. Cl. ..... 123/188.3; 123/188.8

[58] Field of Search ..... 123/188.2, 188.8, 188.3; 251/332, 333, 368

[56] References Cited

U.S. PATENT DOCUMENTS

| | | | |
|---|---|---|---|
| 3,649,380 | 3/1972 | Tauschek | 123/188.3 |
| 4,122,817 | 10/1978 | Matlock | 123/188.3 |
| 5,031,878 | 7/1991 | Ishikawa et al. | 123/188.8 |
| 5,084,113 | 1/1992 | Mori et al. | 123/188.3 |

FOREIGN PATENT DOCUMENTS

| | | | |
|---|---|---|---|
| 0013164 | 3/1981 | Japan | 123/188.3 |
| 0197609 | 9/1987 | Japan | 123/188.3 |
| 64-22497 | 1/1989 | Japan . | |
| 2-92494 | 4/1990 | Japan . | |
| 5-49802 | 7/1993 | Japan . | |
| 5-171908 | 7/1993 | Japan | 123/188.8 |
| 6-81614 | 3/1994 | Japan | 123/188.8 |

*Primary Examiner*—Willis R. Wolfe
*Assistant Examiner*—Erick Solis
*Attorney, Agent, or Firm*—Graham & James

[57] ABSTRACT

There is provided an internal combustion engine valve having a body, a head, and a contact surface disposed on said head adapted to periodically enter into gas-sealing engagement with a valve seat, said contact surface being formed in metal deposit welded to said valve head, the composition of said metal deposit being Al and B free, and measured at said contact surface, consisting essentially of carbon: 1.3 to 2.0 weight percent;
chromium: 19 to 23 weight percent;
molybdenum: 8 to 11 weight percent;
nickel: 17 to 21 weight percent;
manganese: 6 to 13 weight percent;
silicon: less than 0.5 weight percent;
oxygen: less than 0.06 weight percent;

balancing iron and inevitable impurities.

2 Claims, 2 Drawing Sheets

INTERNAL COMBUSTION VALVE HAVING AN IRON BASED HARD-FACING ALLOY CONTACT SURFACE

FIELD OF THE INVENTION

The present invention relates to an iron base hard facing alloy exhibiting good wear properties, resistance to PbO corrosion, and oxidation resistance in a relatively low cost composition.

The alloy powder of the invention has competitive high performance as used for forming a contact surface of engine valves, and can save considerably the cost of the preparation of the facings of engine valves.

The alloy powder of the invention is particularly suitable for utilization as a hard-facing alloy to face contact surfaces of exhaust valve as well as inlet valve of internal combustion engines.

In general, the alloy powder of the present invention is useful wherever a high performance alloy is required for use at high temperature and under corrosive conditions. This type of service is required, for example, of the valves and associated of parts such as valve faces and inserts, which are directly exposed to the high temperatures and the corrosive products of combustion of internal combustion engines. Generally, these parts of engines must withstand exposure to corrosive gases passing thereover at high temperature and at temperatures ranging from about 538° C. or higher, at different parts of the cycle.

DESCRIPTION OF THE PRIOR ART

A conventionally used hard-facing alloy for exhaust valve facings are the Stellite alloy, which are cobalt-chromium facing alloys commonly used in applications where an unfaced austenitic stainless steel valve is otherwise subject to severe face wear and corrosion. The various Stellite alloys including Cobalt based alloy of STL (Stellite) #6 (refer to JIS; 1.2C—1.0Si—30Cr—4-W—Co:balance), STL #32 (1.8C—1.0Si—22Ni—26-Cr—12W—Co:balance) possess excellent high temperature wear resistance, resistance to PbO corrosion and oxidation resistance. However, the Stellite alloys are expensive materials due to their high content of expensive metals such as cobalt, nickel and tungsten. The basic Stellite composition is a non-ferrous alloy of 40 to 80% cobalt, 0 to 25 % tungsten, 20 to 35% chromium and 0.75 to 2.5% carbon.

On the other hand, generally iron based alloy is relatively uncostly, but not good at high temperature performances.

Where iron based alloy has been used for preparation of the contact surface of engine valves by oxyacetylene welding process, the prepared contact surface will entail high possibility of defects found in the contact facings.

U.S. Pat. No. 4,122,817 discloses an engine valve having a contact surface of formed of an alloy which exhibits wear-resistant properties, PbO corrosion resistance and oxidation resistance, and the o alloy containing carbon 1.4 to 2.0 wt. %, molybdenum 4.0 to 6.0 wt. %, silicon 0.1 to 1.0 wt. %, nickel 8 to 13 wt. %, chromium 20 to 26 wt. %, manganese 0 to 3.0 wt. % with balance being iron.

Japanese (Unexamined) Patent Laid-open application No. 2-92494/1991, application filing No. 63-243042/1980 proposed an iron-based alloy powder in use for a material to be coated on facings of an engine valve, which comprises C; 1.0 to 2.5 wt. %, Si; 0.1 to 1.0 wt. %, Mn; 3 to 12 wt. %, Ni; 15 to 25 wt. %, Cr; 20 to 30 wt. %, Mo; 5 to 15 wt. %, B; 0.005 to 0.05 wt. %, Al; 0.01 to 0.1 wt. % and O; 0.01 to 0.05 wt. % with balance being Fe and impurities. In this alloy powder, the addition of relatively uncostly manganese will provide corrosion resistance at desired level, and at the same time, the addition of boron will ensure a certain fluidity at high temperature, and the addition of aluminum will provide homogeneity in the microstructure of the alloy.

Further, Japanese (Unexamined) Patent Laid-open application No. 5-49802/1993 proposed an engine valve having an alloy layer comprising Cr 10 to 60 wt. %, C 1 to 8 wt. %, total content of Mo, Ni, W, B, Si and Co; 5 to 20 wt. % with balance being iron, on a facing surface thereof, which is based on an Austenire steel.

As will be demonstrated, valve facings formed with iron based alloys of the present invention compare very favorably with facings formed from a Stellite alloy.

This is a remarkable accomplishment when it is realized that this high level of performance is achieved at a substantial cost saving when compared with the Stellite alloy, and further compared with the alloy disclosed in Japanese unexamined patent application laid-open No. 2-92494/1991.

SUMMARY OF THE INVENTION

It is an object of the present invention to provide valve facings formed with iron based alloy with highly competitive performance at a substantial cost saving.

It is other object of the present invention to provide such iron based alloy with highly competitive performance without need of addition of boron and aluminum which will enable high homogeneity in the microstructure of the alloy.

It is another object of the present invention to provide an iron based powder alloy composition which comprises only relatively uncostly ingredients.

The further object of the present invention will be understood from the below description.

BRIEF DESCRIPTION OF THE DRAWINGS

A more detailed description of the invention is facilitated by reference to the drawings which form a part of this specification and wherein.

DETAILED DESCRIPTION OF PREFERRED EMBODIMENTS

Figure 1:
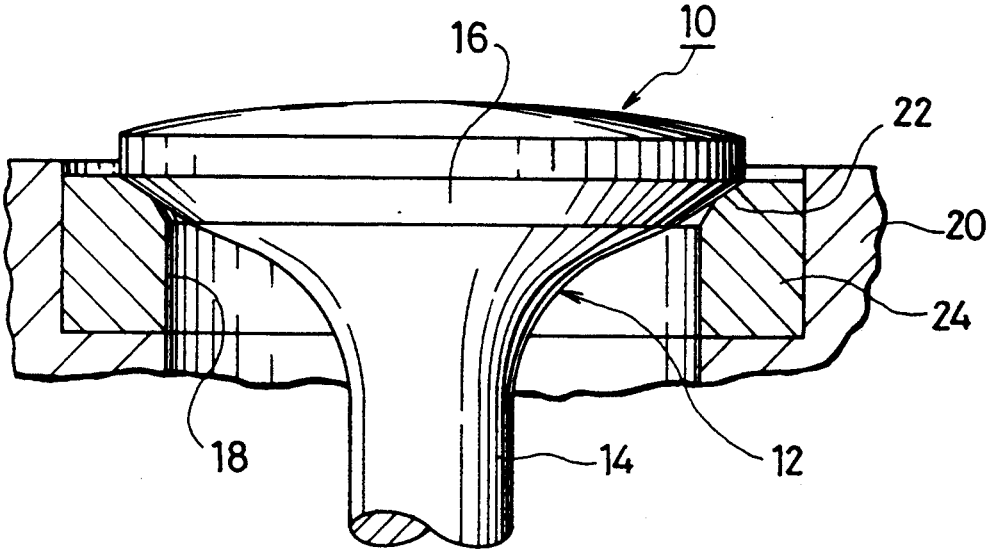
FIG. 1 is a fragmentary elevational view in partial section of a valve head seated in a valve seat.

Referring to FIG. 1, there is shown a partial view in partial section of a valve 10 having a head 12 and a stem 14. A head 12 has a contact surface 16 which is bevelled for gas-sealing engagement with a valve seat surface. A valve opening 18 is formed as part of a valve insert 24, which may be made of a metal having better corrosion and wear resistance and harder than the cast iron metal of which the engine cylinder block or head 20 is Usually made. Valve opening 18 is usually a circular opening, and valve insert 24 is generally a ring-shaped insert provided therein. Accordingly, the contact surface 16 of a valve head 12 should have as good corrosion and wear resistance and hard as the above valve insert 24.

Figure 2:
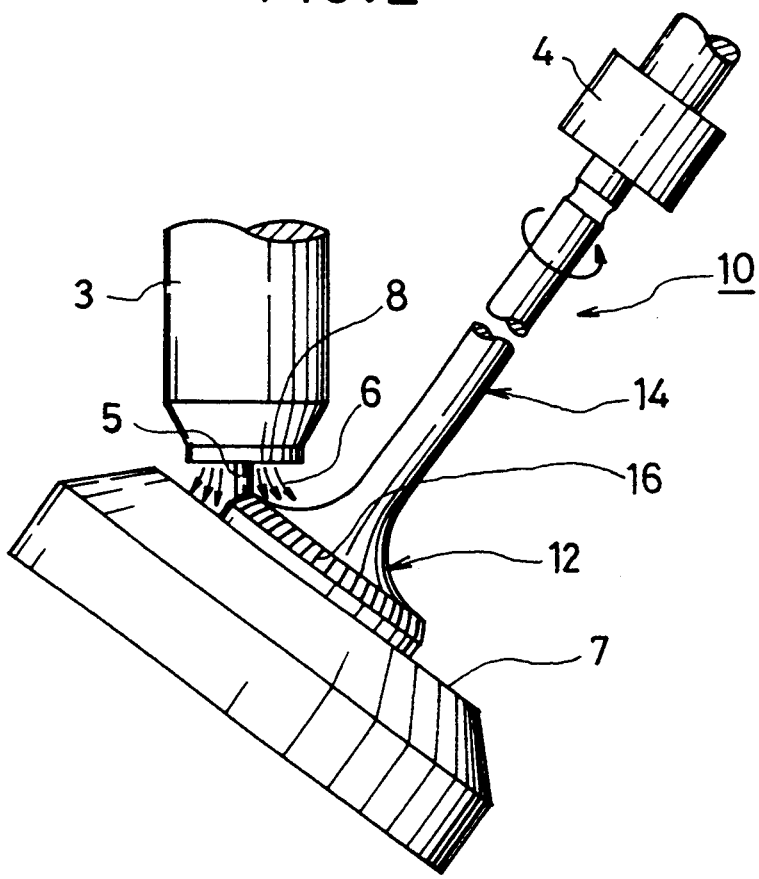
FIG. 2 is a partial, schematic view showing a hard-facing alloy being applied by plasma-torch welding techniques to a valve head.

Referring to FIG. 2, a valve head 12 may be formed from a valve blank having a groove encircling the periphery thereof. The groove provides a site for the deposition of a hard-facing alloy 16 therein. A powder alloy source particles 8 in accordance with the present invention is fed from a plasma powder welding apparatus 3, as shown in FIG. 2, together with a plasma torch 5 accompanying a carrier plasma gas and a shielding gas 6. Then, the alloy source particles are melt within the plasma and deposit within the groove so as to form a hard-facing alloy 16. A hard-facing portion 16 is formed as shown in FIG. 2, which has a contact surface which is adapted to periodically enter into gas-sealing engagement with valve seating surface 24. Valve 10 is thereby provided with contact surface 16 formed in a hard-facing alloy deposit welded to valve head in the valve face area.

As a result, the inventors have developed an internal combustion engine valve having a body, a head, and a contact surface disposed on said head adapted to periodically enter into gas-sealing engagement with a valve seat, said contact surface being formed in metal deposit welded to said valve head, the composition of said metal deposit, measured at said contact surface, consisting essentially of the following ingredients.

Valve blanks employed in the practice of the present invention can be formed of a variety of conventional alloys, representative example of which are identified below.

Similarly, the composition and proportion of ingredients in the powder source alloy for forming the valve face can vary over reasonably wide limits.

What is critically important is that the powder alloy to be deposited on the valve head, and particularly the contact surface of formed therein contain the following ingredients in the proportion below:

carbon: 1.3 to 2.0 weight percent;
chromium: 19 to 23 weight percent;
molybdenum: 8 to 11 weight percent;
nickel: 17 to 21 weight percent;
manganese: 6 to 13 weight percent;
silicon: less than 0.5 weight percent;
oxygen: less than 0.06 weight percent;
balancing iron and inevitable impurities.

The reasons for the limitation of each ingredient in the alloy powder composition in use for the preparation of the contact surface of engine valves are as follows:

Carbon is an additive to ensure hardness and abrasion resistance of the contact surface at the desired level.

When the content of carbon is less than 1.3% by weight, the hardness and the abrasion resistance cannot be afforded at desired levels. Further, when the content of carbon exceed 2.0% by weight, the hardness of the contact surface will be excessive and the toughness will be reduced. Then, more preferable range of carbon content is 1.65% by weight to 1.9% by weight.

Chromium is added so as to contribute the raise of corrosion resistance particularly acid resistance. When the content of chromium is less than 19% by weight, the acid resistance cannot be afforded at the desired sufficient level. Further, when the content of chromium exceeds 23% by weight, the high cost of chromium will raise significantly the cost of preparation of the contact surface. The range below 21% by weight is more preferable.

Molybdenum is added so as to establish the hardness of the contact surface and the high temperature strength thereof at the desired levels. When the content of molybdenum is less than 8% by weight, the high temperature hardness is not enough, and further, the desired abrasion resistance can not be afforded. When the content of molybdenum exceeds 11% by weight, the hardness of the contact surface will be excessive and the toughness will be reduced. Then, particularly when the content of molybdenum is below 9% by weight, the abrasion resistance is not enough. Further, when the content of molybdenum exceeds 10.5% by weight, the hardness and the toughness of the contact surface will be affected.

Nickel is added so as to improve a PbO resistance and a $PbO+PbSO_4$ resistance. When the content of nickel is less than 17% by weight, the corrosion resistance is not enough. When the content of nickel exceeds 21% by weight, the high cost of nickel will raise the preparation cost of iron based powder alloy. Particularly when the content of nickel is below 19 % by weight, the corrosion resistance is significantly insufficient.

Manganese is added as a deoxidizer, in place of Nickel element, to improve the PbO resistance. When the content of manganese is less than 6% by weight, the corrosion resistance is not enough. Further, when the content of manganese exceeds 13% by weight, the fluidity of material at the high temperature will be affected so as to raise the defect rate found in the prepared surface. Particularly when the content of manganese is below 11% by weight, the PbO resistance will be significantly insufficient.

Silicone is added as a deoxidizer. When the content of silicone exceeds 0.5% by weight, the performance of the prepared facings will be reduced so that occurrence of pin holes therein can be raised.

When the content of oxygen atoms exceeds 0.06% by weight, the occurrence of pin holes will be raised, and then the defect rate of the product will be raised. Further, more preferably the content of oxygen atoms ranges below 0.02% by weight.

Powder Welding technique:

The facing powder alloy of the present invention may be applied by the known welding processes, including plasma arc, and laser powder welding such as inert gas shielded welding.

Such processes may conveniently be automated to proved a high rate of production of hard-faced engine valves.

Further, more preferable ranges in the powder alloy composition of the present invention is as follows;

carbon: 1.65 to 1.9 weight percent;
chromium: 19 to 21 weight percent;
molybdenum: 9 to 10.5 weight percent;
nickel: 19 to 21 weight percent;
manganese: 11 to 13 weight percent;
silicon: less than 0.5 weight percent;
oxygen: less than 0.02 weight percent;
balancing iron and inevitable amount of impurities.

It will be appreciated by those skilled in the art that a contact surface having the desired proportions of metallurgical ingredients can be realized by interplaying valve blank metallurgy, weld wire metallurgy, and welding conditions. Thus, increasing the energy supplied during welding, increases by dilution the metallurgical contribution to the weld metal of ingredients contained in the valve blank. Conversely, decreasing the energy supplied during welding will decrease the contribution made by the valve blank :and a compensating adjustment may have to be made in the composition of the weld wire or other primary source of weld metal to provide a contact surface having the desired composition.

Suitable alloys from which may be formed valve blanks useful in the practice of the invention, including the following:

| Element | weight percent |
|---|---|
| 21-2N: | |
| C | 0.50 to 0.60 |
| Mn | 7.0 to 9.5 |
| Si | 0.25 max. |
| N | 0.20 to 0.40 |
| Cr | 19.25 to 21.50 |
| Ni | 1.50 to 2.75 |
| Fe | balance |
| SUH 36: | |
| C | 0.48 to 0.58 |
| Mn | 8.0 to 10.0 |
| Si | 0.35 max. |
| Cr | 20.0 to 22.0 |
| Ni | 3.25 to 4.50 |
| N | 0.35 to 0.50 |
| Fe | balance |

ENGINE TEST FOR WEAR AND OXIDATION RESISTANCE

Valve Preparation

The present invention is further illustrated by the following example to show the valve facing alloy of the present invention, but should not be interpreted for the limitation of the invention.

EXAMPLE

Valve Preparation

A series of valve blanks formed from the alloy of 21-2N, and having heads measuring 23.5 mm in diameter, were provided with an iron based hard-facing alloy by a plasma arc powder welding method, the seat area of the valve, using a powder alloy material having the following compositions for each specimen.

TABLE 1

| specimen No. | Composition (% by weight) | | | | | | | | | |
|---|---|---|---|---|---|---|---|---|---|---|
| | C | Cr | Mo | Ni | Mn | Si | O | Al | B | Fe |
| 1 | 1.3 | 20 | 8 | 20 | 12 | 0.2 | 0.01 | — | — | balance |
| 2 | 1.6 | 19 | 9 | 20 | 11 | 0.3 | 0.01 | — | — | balance |
| 3 | 1.8 | 20 | 10 | 20 | 12 | 0.2 | 0.02 | — | — | balance |
| 4 | 2.0 | 22 | 10 | 21 | 12 | 0.2 | 0.02 | — | — | balance |
| 5 | 1.8 | 20 | 10 | 20 | 12 | 0.2 | 0.02 | 0.02 | 0.01 | balance |
| 6 | 2.0 | 23 | 8 | 17 | 6 | 0.1 | 0.01 | 0.09 | 0.01 | balance |

The welding parameters include the following:

Size of the iron-based alloy particles for welding: 80 mesh to 350 mesh

Weight of the contact surface per one valve: 2.7 g.

Cycle speed: 12 sec.

Welding plasma current (steady): 100 amp.

Plasma argon gas rate: 1.3 1/min.

Rate of argon gas to feed the powder: 1.0 1/min.

Feed rate of argon shield gas: 10.0 1/min.

Pretreatment of the valve blanks and post treatment of the hard-face valve followed conventional production practice well known ! to those skilled in the art.

The defect percent of the products is total sum of the defects caused in the preparation and the defects found in the finish product.

Measurement

The hardness of the prepared contact surface was measured by Vickers hardness meter at loading of 5 kg.

Engine Test

Each of the specimen valves was tested for 200 hours in an engine of 5400 rpm, using lead gasoline (Pb 1.5 g/gallon).

The engine operating parameters, including speed, load, timing and air fuel ratio were kept constant throughout the test, so that as far as possible all variables were eliminated, save for the exhaust valve facing powder alloy.

After 200 hour test, the amount of wear was measured. As shown in Table 2, the amount of wear of the contact surface is considered to be minimal.

Corrosion Test

Each of the specimen was tested in three separate corrosion tests.

Specimens were prepared from the powder alloy measuring about 10 mm in diameter and 12 mm in length.

The first test is to test oxidation deterioration. After 100 hour exposure at the temperature of 1000° C. in ambient atmosphere, :the amount of weight reduction was measured.

In the second test, the PbO corrosion test procedure involves placing a weighed specimen in an alumina crucible together with 40 g of PbO. The crucible was then heated to 920° C. for one hour in air. Upon cooling, the treated specimen was again weighted and the weight loss, expressed in mg/cm$^2$ was determined.

Further, in the third test, the $6PbO+4PbSO_4$ test was carried out by substituting a crucible of PbO with $6PbO+4PbSO_4$ crucible, and the crucible was heated to 900° C. for one hour in air. The specimen upon cooling was weighted and the weight loss was determined in the similar way.

The results are shown in Table 2.

TABLE 2

| specimen No. | defect percent | hardness (Hv) | abrasion (micrometer) | corrosion (mg/cm$^2$) | | |
|---|---|---|---|---|---|---|
| | | | | Oxidation | PbO | $PbSO_4$ |
| 1 | 0.2 | 400 | 5 | 1.9 | 85 | 91 |
| 2 | 0.1 | 410 | 3 | 2.0 | 83 | 93 |
| 3 | 0.2 | 420 | 3 | 2.0 | 73 | 80 |
| 4 | 0.1 | 430 | 2 | 2.6 | 67 | 76 |
| 5 | 0.1 | 420 | 2 | 3.0 | 70 | 90 |
| 6 | 0.2 | 420 | 5 | 1.8 | 83 | 85 |

It is clear from these test results that the valves provided with iron based hard-facing powder alloys of the present invention are fully comparable in terms of wear and oxidation resistance, under the test conditions described, to the substantially more expensive and highly regard Stellite F facing and Mn-added iron-based alloy facing as disclosed in the above cited patent application laid open of the prior art.

In general, weight losses of up to about 90 mg/cm$^2$/hour have been found to correlate with satisfactory PbO and $6PbO+4PbSO_4$ corrosion resistance exhibited in engine tests.

Without addition of Al and B elements, the composition of the powder alloy as used for facing of an engine valve in accordance with the present invention has competitive performance with the alloy disclosed in Japanese Unexamined Patent application Laid-open No. 2-92494/1991.

The preferable range of Mn in the composition is 11 to 13 weight %.

A plasma arc powder welding process was used in the preparation of the contact surface of the engine valve, but other inert gas shield welding process such as laser powder welding method can be used so as to result in similar welding formation.

The powder alloy of the present invention as used for the formation of the contact surface of engine valves entails highly competitive performance even without any addition of aluminum and boron so as to save the preparation cost.

Further, high hardness and high corrosion resistance of the contact surface as formed can be afforded in accordance with present invention.

We claim;

1. An internal combustion engine valve having a body, a head, and a contact surface disposed on said head adapted to periodically enter into gas-sealing engagement with a valve seat, said contact surface being formed in metal deposit welded to said valve head, the composition of said metal deposit, measured at said contact surface, consisting essentially of carbon: 1.3 to 2.0 weight percent;
chromium: 19 to 23 weight percent;
molybdenum: 8 to 11 weight percent;
nickel: 17 to 21 weight percent;
manganese: 6 to 13 weight percent;
silicon: less than 0.5 weight percent;
oxygen: less than 0.06 weight percent;
balancing iron and inevitable impurities.

2. The valve defined in claim 1, wherein the preferable composition of said metal deposit, measured at said contact surface, consisting essentially of carbon: 1.65 to 1.9 weight percent;
chromium: 19 to 21 weight percent;
molybdenum: 9 to 10.5 weight percent;
nickel: 19 to 21 weight percent;
manganese: 11 to 13 weight percent;
silicon: less than 0.5 weight percent;
oxygen: less than 0.02 weight percent;
balancing iron and inevitable impurities.

* * * * *